United States Patent [19]

Todd et al.

[11] 4,027,681

[45] June 7, 1977

[54] PIPE REAMER AND CAPTURE TRAY

[76] Inventors: Jackson D. Todd, 602 Berkley Drive; Francis C. Yarger, 1107 Windsor Drive, both of Marion, Ind. 46952

[22] Filed: Oct. 28, 1975

[21] Appl. No.: 626,080

[52] U.S. Cl. ..... 131/232; 131/246

[51] Int. Cl.[2] ..... A24F 19/10

[58] Field of Search ..... 131/232, 246

[56] References Cited

UNITED STATES PATENTS

| | | | |
|---|---|---|---|
| 1,445,033 | 2/1923 | Palmquist | 131/246 X |
| 1,932,625 | 10/1933 | Hopple | 131/232 |
| 3,256,891 | 6/1966 | Katt | 131/246 |

FOREIGN PATENTS OR APPLICATIONS

| | | | |
|---|---|---|---|
| 210,626 | 2/1924 | United Kingdom | 131/232 |

*Primary Examiner*—Stephen C. Pellegrino

[57] ABSTRACT

A supportive tray upstandingly supports an elongated resilient planar loop having convexly contoured reaming sides and an arcuate reaming arch. An inverted pipe bowl placed on and pressed downwardly on the arch deforms the convex sides into conforming engagement with the concavely formed bowl sides to perform a reaming function upon rotation of the bowl relative the loop to remove ash and dottle from the pipe bowl.

1 Claim, 4 Drawing Figures

PIPE REAMER AND CAPTURE TRAY

BACKGROUND OF THE INVENTION

1. Field of the Invention

This invention relates generally to a smoking pipe reamer with a capture tray for the reamed ash and dottle.

2. Description of the Prior Art

Many pipe reaming and capture tray devices are available in the art. These devices range from relatively simple to relatively complex. The object in all is to clean and capture the ash and dottle from a pipe bowl by a scraping action on the bowl sides and bottom. Blades, brushes, and wire frames have been used, with varying degrees of reaming ability and complexity. In general, these devices, although available for many years, have not been widely accepted due to cost, complexity and ineffectiveness.

SUMMARY OF THE INVENTION

An elongate resilient loop having convexly contoured sides and an arcuate arch is removably attached to and upstandingly supported by the bottom of an ash and dottle capture tray in a loop-defined plane. The convexity of the contour is designed to accept and conform in convex deformation a concavely formed smoking pipe bowl. Thus a scraper having conforming flexibility to a wide range of pipe bowls is provided. The conforming deformation of the scraper is in response to a downward longitudinal thrust of a pipe bowl bottom on the loop arch. The planar configuration of the loop facilitates in converting the downward thrust to a conforming deformation not possible with prior art reamers. With the device of this invention, simplicity in construction and economy of manufacture are combined with superior bowl cleaning capability.

It is therefore an object of the invention to provide a pipe reamer and capture tray that will ream cleanly and will conform to a wide variety of pipe bowl sizes, is of simple construction, and economical of manufacture and maintenance.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF A PREFERRED EMBODIMENT

Figure 1:
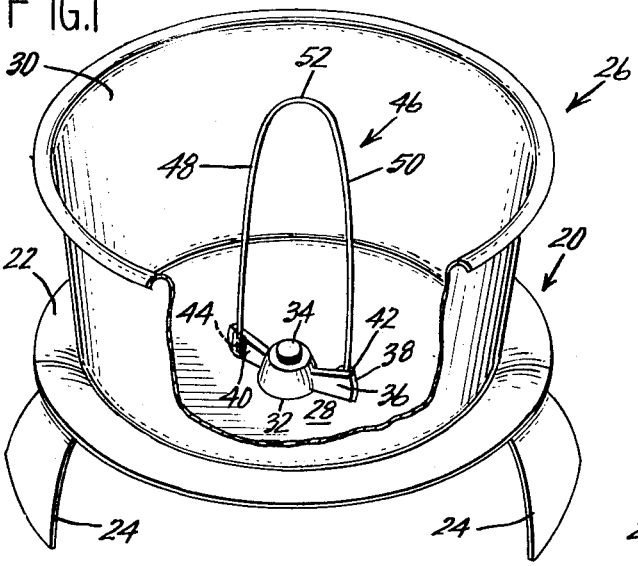
FIG. 1 is a view in perspective, partially broken away, of a preferred embodiment of this invention.
Figure 2:
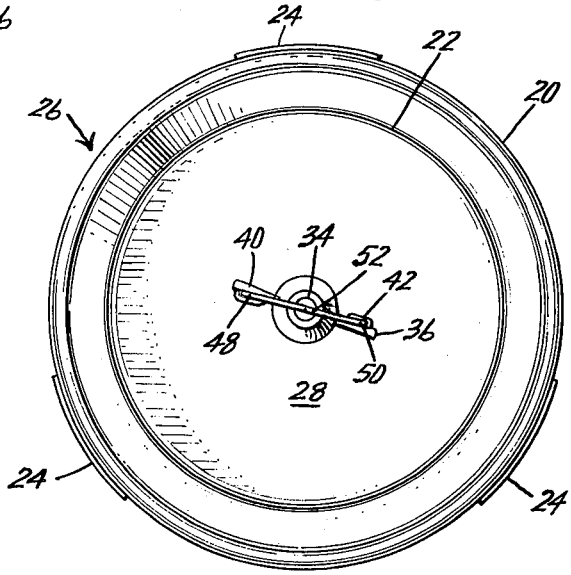
FIG. 2 is a top plan view of the embodiment of FIG. 1.
Figure 3:
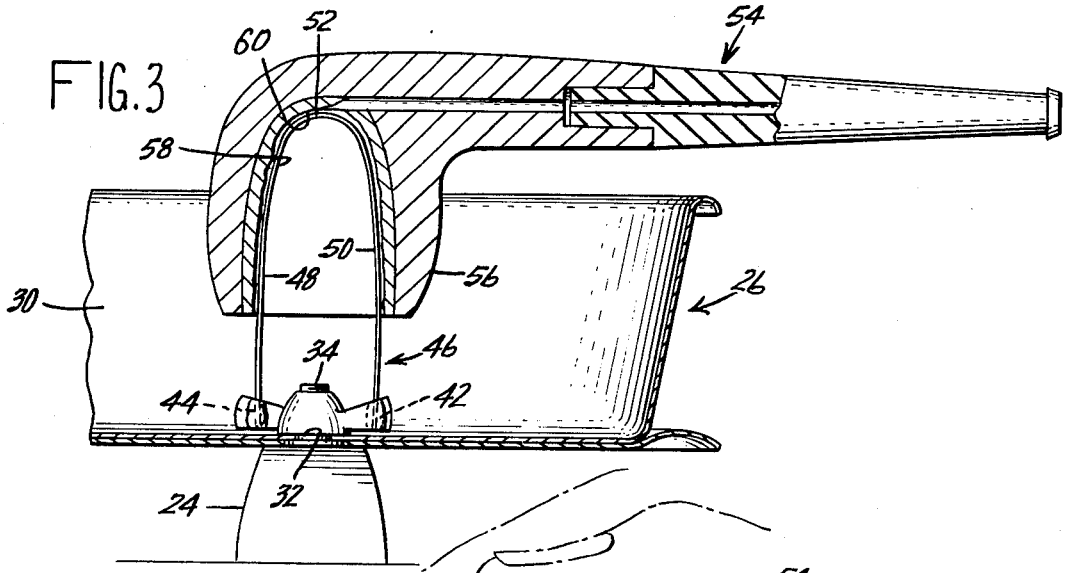
FIG. 3 is a partial view in section of a pipe inserted over a reamer of this invention.

Referring to the drawing, a stand 20 having a circular base plate 22 and supporting legs 24, which may be made of a plastic or metallic material, supports a capture tray 26. Tray 26 has a bottom surface 28 and a peripheral wall 30. A threaded stud 34 is fixedly supported in upstanding relation to stand 20 and is received by opening 32 in the bottom 28. Stud 34 may extend beneath tray 26 for attachment to a vehicle floor so that the reamer-tray may be used by the vehicle operator. A wing nut 36, having wings 38 and 40, has fixed thereto, as by soldering, the ends 42 and 44 of loop 46. Loop 46 has convexly contoured sides 48 and 50 joined by arcuate arch 52, and may be made of a strong, resilient material such as piano wire. Loop 46 extends above wall 30 so that a pipe may conveniently be placed thereon without interference.

Figure 4:
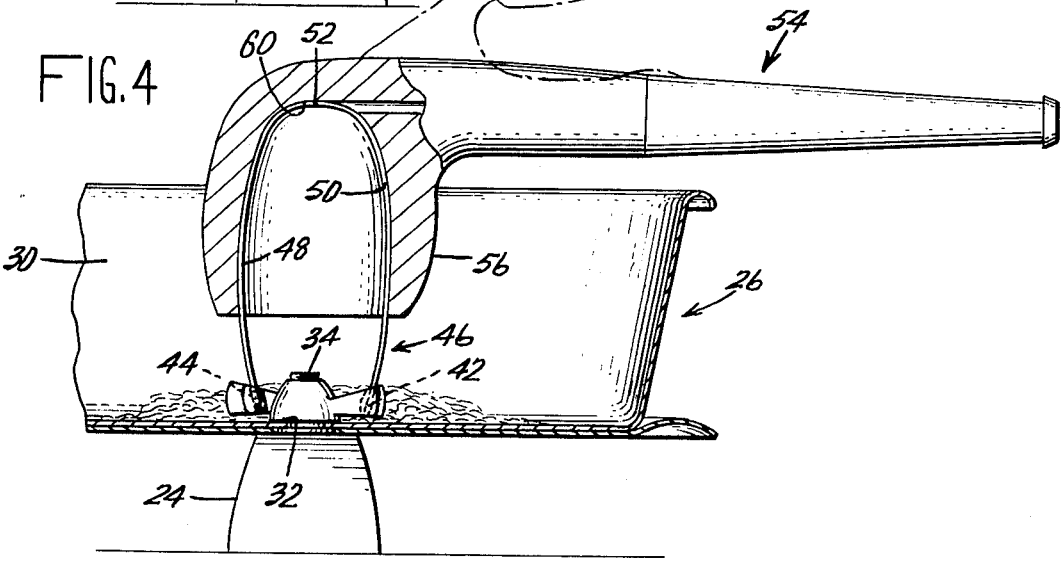
FIG. 4 is a view similar to FIG. 3 after the pipe has been pressed downwardly on the reamer.

In operation of this embodiment, a pipe 54 having bowl 56 with inner wall 58 and bottom 60 is inverted over loop 46 and is pressed downwardly on the loop 46 causing sides 48 and 50 to bow outwardly in contact with substantial portions of wall 58 and bottom 60 as seen in FIG. 4. A rotative action applied to pipe 54 causes the ash and dottle to be cleaned therefrom where it is captured in tray 26.

Loop 46 defines a substantially vertical plane and due to the planar orientation of the loop, and the convexly contoured sides 48 and 50, a downward longitudinal thrust of pipe 54 will cause the loop readily to assume a conforming reaming configuration as shown in FIG. 4. The concavely formed walls 58 of bowl 56 are engaged along a substantial length by the loop 46 with a minimum of downward pressure. Due to the convexity of sides 48 and 50, and due to the planar disposition of sides 48 and 50, a downward pressure on arch 52 will readily result in the outward bowing of sides 48 and 50 against the contoured wall 58.

While there have been described above the principles of this invention in connection with specific apparatus, it is to be clearly understood that this description is made only by way of example and not as a limitation to the scope of the invention.

What is claimed is:

1. A pipe reamer-capture tray for cleaning a pipe bowl comprising:

a supportive tray having a bottom surface and upstanding peripheral walls for ash and dottle containment;

a single, unitary, elongated resilient loop element formed of relatively stiff wire having a pair of convexly curved side portions smoothly joined by an arcuate arch portion, said side portions having distal ends; said loop element lying in a loop-defined fixed plane; supporting means having said distal ends of said side portions secured thereto for supporting said element on said bottom surface of said tray in upstanding relationship therewith and in said loop-defined fixed plane whereby said side and arch portions resiliently conform to the inner surface of a pipe bowl for reaming the same upon insertion therein and application of downward rotative force thereon; and said supporting means comprises a member having said distal ends secured thereto, fastener means for securing said member to said bottom surface.

* * * * *